US005435243A

United States Patent [19]

Makino et al.

[11] Patent Number: 5,435,243

[45] Date of Patent: Jul. 25, 1995

[54] WETTING APPARATUS AND METHOD FOR OFFSET PRINTING MACHINES

[75] Inventors: Shigeo Makino; Kazuhiko Sato, both of Hiroshima; Katsutoshi Okazaki, Mihara; Hajime Yagi, Mihara; Fumihide Kimura, Mihara, all of Japan

[73] Assignee: Mitsubishi Jukogyo Kabushiki Kaisha, Tokyo, Japan

[21] Appl. No.: 229,176

[22] Filed: Apr. 18, 1994

[30] Foreign Application Priority Data

Apr. 22, 1993 [JP] Japan ..... 5-096074

[51] Int. Cl.[6] ..... B41F 7/26

[52] U.S. Cl. ..... 101/148; 101/350

[58] Field of Search ..... 101/147, 148, 349, 350, 101/206, 207, 208, 209, 210

[56] References Cited

U.S. PATENT DOCUMENTS

| | | | |
|---|---|---|---|
| 3,842,735 | 10/1974 | Southam et al. | 101/148 |
| 4,440,081 | 4/1984 | Beisel | 101/350 |
| 4,461,208 | 7/1984 | Ghisalberti | 101/148 |
| 4,584,940 | 4/1986 | Germann et al. | 101/148 |
| 4,944,223 | 7/1990 | Ishii et al. | 101/148 |
| 4,986,176 | 1/1991 | Ishii et al. | 101/148 |
| 5,003,871 | 4/1991 | Franz et al. | 101/148 |
| 5,174,210 | 12/1992 | Rodi et al. | 101/148 |

FOREIGN PATENT DOCUMENTS

| | | | |
|---|---|---|---|
| 2446718 | 1/1980 | France . | |
| 3334470 | 4/1985 | Germany | 101/148 |
| 2093771 | 9/1982 | United Kingdom . | |

*Primary Examiner*—Ren Yan

[57] ABSTRACT

A wetting apparatus for offset printing machines comprising a first wetting roller immersed in a pan having dampening solution, a metering roller contacting with the first wetting roller, a second wetting roller contacting with the metering roller and with a printing surface, an ink application roller contacting with the printing surface, an ink receiving roller rotatably in contact with the second wetting roller and movable toward and away from at least one of the metering roller and the ink application roller, a vibrating roller rotatably in contact with the ink application roller, and an ink transferring roller rotatably in contact with the vibrating roller and movable toward and away from the ink receiving roller.

9 Claims, 5 Drawing Sheets

WETTING APPARATUS AND METHOD FOR OFFSET PRINTING MACHINES

FIELD OF THE INVENTION AND RELATED ART STATEMENT

The present invention relates to a wetting apparatus and method of wetting for offset printing machines.

A lithography offset plate comprises hydrophilic portions and chemically treated ink-wettable portions, and a film of a dampening solution has to be held properly on the hydrophilic portions for favorable printing results. Generally, a dampening solution is fed to the printing surface and then a film of ink is applied from an ink application roller to the printing surface. At that time, the dampening solution on the printing surface mixes with the ink on the ink application roller. This mixing will hereinafter be referred to as "emulsification". When the ink application roller rotates and comes again in contact with the printing surface, the mixed solution on the roller is discharged as dampening solution on the printing surface, the hydrophilic portion is supplemented, and printing is performed. This discharge from the ink application roller will hereinafter be referred to as "emulsion breaking".

A continuous wetting apparatus has been used widely, since it provides relatively superior printing quality and its maintenance easier than apparatuses incorporating other methods, such as a brush method and a spray method. The continuous wetting apparatus is grouped into three types: printing surface wetting type, ink application roller wetting type, and combination type of these.

Among these types, in the continuous wetting apparatus of the printing surface wetting type, a dampening solution is fed directly to a printing surface 9 by a series of rollers 2, 3 and 4, shown in FIG. 5(*a*). In the ink application roller wetting type apparatus, as shown in FIG. 5(*b*), a dampening solution is fed to one of the rollers in an ink supply device (e.g., an ink application roller 7) and not to the printing surface 9, and the hydrophilic portion of the printing surface 9 is wetted mainly by the above emulsion breaking. In the continuous wetting apparatus of the combined type, as shown in FIG. 5(*c*), the dampening solution is fed directly to a printing surface 9 by a series of rollers 2, 3 and 4, and the wetting roller 4 and an ink application roller 7 are connected through a bridge roller 10. In FIGS. 5(*a*)–5(*c*), reference numeral 8 denotes a vibrating roller.

For desirable printing, the dampening solution is required to be fed as a uniform film to the printing surface, and a proper degree of emulsification in the ink apparatus is required. The proper degree of emulsification is a level of emulsification at which the emulsion breaking occurs to such an extent that a boundary between the picture-line portion (ink wettable portion or work portion) and the non-picture-line portion (hydrophilic portion) is supplemented with the dampening solution. If the proper degree of emulsification cannot be obtained and maintained, such defects as ghosts, roller eyes or defective screen or halftone reproduction will occur in prints.

The emulsification state of the ink apparatus varies with wetting methods and also with the ratio of picture-line portions in a print. For example, emulsification in the continuous wetting apparatus of printing surface wetting type is a so-called indirect emulsification in which the dampening solution on a printing surface is absorbed by an ink application roller, and emulsification is relatively difficult. Therefore, in order to obtain a proper degree of emulsification, the amount of dampening solution supplied to the printing surface has to be increased. However, particularly in the case of a high ratio of picture-line portions, a film of dampening solution becomes thick and sometimes water marks or roller eyes occur.

In the continuous wetting apparatus of the ink application roller wetting type, as compared with the printing surface wetting type, the emulsification is relatively easy because the dampening solution is fed directly to the ink application roller. However, if the ratio of picture-line portions is small, so-called excessive emulsification tends to occur. As a consequence, defective screen reproductions or ghosts occur due to flawed ink transfer.

The continuous wetting apparatus of the combination type can be classified somewhere between the printing surface wetting type and the ink application roller wetting type. In the combination type, the dampening solution is fed to a printing surface and also to an ink application roller which is connected by the bridge roller, in order to compensate for the drawbacks of the aforementioned two types.

However, there is a drawback in that the excessive emulsification on the ink application roller cannot be eliminated completely, because the film of dampening solution on the printing surface is improved by the transfer of emulsified solution and the wetting roller has a film of ink like the ink application roller.

OBJECT AND SUMMARY OF THE INVENTION

Accordingly, an important object of the present invention is to provide a wetting apparatus and a wetting method for offset printing machines which are capable of minimizing roller eyes and ghosts and of improving screen reproduction over a wide range of ratios of picture-line portions to non-picture portions.

A first aspect of the present invention provides a wetting apparatus for offset printing machines which comprises a first wetting roller immersed in a pan holding dampening solution, a metering roller which is in contact with the first wetting roller, a second wetting roller which is in contact with a printing surface and the metering roller, an ink application roller which is in contact with the printing surface, an ink receiving roller which is rotatably in contact with the second wetting roller and which may be contacted with and separated from at least one of the metering roller and the ink application roller, a vibrating roller which vibrates and rotates in contact with the ink application roller, and an ink transferring roller which is rotatably in contact with the vibrating roller and may be contacted with and separated from the ink receiving roller.

In addition, the present invention provides a wetting method for offset printing machines which method comprises, when printing while continuously feeding a dampening solution to a printing surface through a first wetting roller immersed in a dampening solution pan and a metering roller and a second wetting roller which is in contact with the printing surface, the steps of moving an ink transferring roller away from an ink receiving roller, and moving an ink receiving roller away from an ink application roller which is in contact with the printing surface, so that the dampening solution is supplied from the second wetting roller to the printing surface.

Further, the present invention provides a wetting method of an offset printing machine which method comprises, when printing while continuously feeding a dampening solution to a printing surface through a first wetting roller immersed in a dampening solution pan, a metering roller, and a second wetting roller which is in contact with the printing surface, the steps of bringing an ink receiving roller into contact and rotation with an ink application roller which is in contact with the printing surface, and moving an ink transferring roller away from the ink receiving roller, in such a way that the dampening solution is supplied to the printing surface from the second wetting roller through the ink receiving roller and the ink application roller.

Moreover, the present invention provides a wetting method for offset printing machines which method comprises, when printing while continuously feeding a dampening solution to a printing surface through a first wetting roller immersed in a dampening solution pan and a metering roller and a second wetting roller which is in contact with the printing surface, the steps of bringing an ink receiving roller into contact and rotation with an ink transferring roller, and moving the ink receiving roller away from the ink application roller, in such a way that the dampening solution is supplied to the printing surface from the second wetting roller through the ink receiving roller and the ink transferring roller and the vibrating roller and ink application roller.

Furthermore, the present invention provides a wetting method for offset printing machines which method comprises, when printing while continuously feeding a dampening solution to a printing surface through a first wetting roller immersed in a dampening solution pan and a metering roller and a second wetting roller which is in contact with the printing surface, the step of bringing an ink receiving roller into contact and rotation with an ink transferring roller and an ink application roller, in such a way that the dampening solution is supplied to the printing surface from the second wetting roller through the ink receiving roller and the ink transferring roller and the vibrating roller and ink application roller and also from the second wetting roller through the ink receiving roller and the ink application roller.

Still further, the present invention provides a wetting method for offset printing machines which method comprises, when printing while continuously feeding a dampening solution to a printing surface through a first wetting roller immersed in a dampening solution pan and a metering roller and a second wetting roller which is in contact with the printing surface, the step of bringing an ink receiving roller into contact and rotation with the metering roller, in such a way that the dampening solution is supplied to the printing surface from the metering roller.

The present invention is constructed as described above, and when printing while the dampening solution is continuously fed to the printing surface through the first wetting roller, the metering roller, and the second wetting roller, an optimum emulsification corresponding to each print is obtained: (1) by moving the ink transferring roller away from the ink receiving roller, moving the ink receiving roller away from the ink application roller, and feeding the dampening solution from the second wetting roller to the printing surface; or (2) by bringing the ink receiving roller into contact and rotation with the ink application roller, moving the ink transferring roller away from the ink receiving roller, and feeding the dampening solution to the printing surface from the second wetting roller through the ink receiving roller and the ink application roller; or (3) by moving the ink receiving roller away from the ink application roller, bringing the ink transferring roller into contact and rotation with the ink receiving roller, and feeding the dampening solution to the printing surface from the second wetting roller through the ink receiving roller, the ink transferring roller, the vibrating roller, and the ink application roller; or (4) by bringing the ink receiving roller into contact and rotation with the ink application roller, bringing the ink transferring roller into contact with the ink receiving roller and rotating the ink transferring roller, and feeding the dampening solution to the printing surface from the second wetting roller through the ink receiving roller and the ink transferring roller and the vibrating roller and the ink application roller, and also from the second wetting roller through the ink receiving roller and the ink application roller; or (5) by contacting and rotating the metering roller and the ink received roller, and feeding the dampening solution.

A second aspect of the present invention provides a wetting apparatus for offset printing machines which comprises a first wetting roller immersed in a pan holding dampening solution, a metering roller which is in contact with the first wetting roller, a second wetting roller which is in contact with a printing surface and the metering roller, an ink application roller which is in contact with the printing surface, an ink receiving roller which is rotatably in contact with the second wetting roller and which may be contacted with and separated from at least one of the metering roller and the ink application roller, a vibrating roller which vibrates and rotates in contact with the ink application roller, and an ink transferring roller which is rotatably in contact with the ink receiving roller and which may be contacted with and separated from the vibrating roller.

In addition, the second aspect of the present invention provides a wetting method for offset printing machines which method comprises, when printing while continuously feeding a dampening solution to a printing surface through a first wetting roller immersed in a dampening solution pan and a metering roller and a second wetting roller which is in contact with the printing surface, the steps of bringing an ink receiving roller into contact and rotation with the second wetting roller and not with an application roller, and bringing an ink transferring roller into contact and rotation only with the ink receiving roller, so that the dampening solution is fed to the printing surface through the second wetting roller.

Further, the second aspect of the present invention provides a wetting method for offset printing machines which method comprises, when printing while continuously feeding a dampening solution to a printing surface through a first wetting roller immersed in a dampening solution pan and a metering roller and a second wetting roller which is in contact with the printing surface, the step of bringing an ink receiving roller which is in contact with the second wetting roller into contact and rotation with an ink application roller which is in contact with the printing surface, so that the dampening solution is fed to the printing surface through the ink application roller.

Moreover, the second aspect of the present invention provides a wetting method for offset printing machines which method comprises, when printing while continuously feeding a dampening solution to a printing surface through a first wetting roller immersed in a dampening solution pan and a metering roller and a second wetting roller which is in contact with the printing surface, the steps of bringing an ink transferring roller which is in contact with an ink receiving roller into contact and rotation with a vibrating roller which is in contact with an ink application roller, and bringing the ink receiving roller into contact and rotation with the ink application roller, in such a way that the dampening solution is fed to the printing surface through the vibrating roller and the ink application roller.

Still further, the second aspect of the present invention provides a wetting method for offset printing machines which method comprises, when printing while continuously feeding a dampening solution to a printing surface through a first wetting roller immersed in a dampening solution pan and a metering roller and a second wetting roller which is in contact with the printing surface, the steps of bringing an ink transferring roller which is in contact with an ink receiving roller into contact and rotation with a vibrating roller which is in contact with an ink application roller, and bringing the ink receiving roller into contact with the ink application roller, the ink application roller being in contact with the printing surface, in such a way that the dampening solution is fed to the printing surface through the vibrating roller and the ink application roller.

The present invention is constructed as described above, and when printing while the dampening solution is being fed continuously to the printing surface through the first wetting roller, the metering roller and the second wetting roller, an optimum emulsification corresponding to a printed matter is obtained: (1) by rotating the ink receiving roller in a state that the receiving roller is in contact with the second wetting roller, rotating the ink transferring roller in a state that the ink transferring roller is in contact with the ink receiving roller, and feeding the dampening solution from the second wetting roller to the printing surface; or (2) by bringing the ink receiving roller into contact with the ink application roller and rotating the receiving roller, and feeding the dampening solution to the printing surface through the ink application roller; or (3) by bringing the ink transferring roller into contact with the vibrating roller and rotating the ink transferring roller, and feeding the dampening solution to the printing surface through the vibrating roller and the ink application roller; or (4) by bringing the ink receiving roller into contact with the ink application roller and rotating the receiving roller, bringing the ink transferring roller into contact with the vibrating roller and rotating the ink transferring roller, and feeding the dampening solution to the printing surface through the vibrating roller and the ink application roller.

According to the present invention constructed as described above, the following effects can be achieved. That is, although a single type of the aforementioned conventional wetting apparatuses has been shown to be insufficient for printing a variety of printed matters in the most desirable manner and some problems have been unavoidable, the wetting apparatus and wetting method of the present invention are capable of freely changing the manner of feeding the dampening solution and optimizing emulsification corresponding to a particular print. Further, the wetting apparatus and method of the present invention are capable of minimizing roller eyes and ghosts over a wide range ranging from low to high picture-line ratios and enhancing a reproducibility of screens.

BRIEF DESCRIPTION OF THE DRAWINGS

The above and other objects and advantages will become apparent from the following detailed description when read in conjunction with the accompanying drawings wherein:

FIG. 5(*b*) is a side view showing a conventional wetting apparatus of the ink application roller wetting type of an offset printing machine; and FIG. 5(*c*) is a side view showing a conventional wetting apparatus of the combination type of an offset printing machine.

DETAILED DESCRIPTION OF THE PREFERRED EMBODIMENTS

Figure 1:
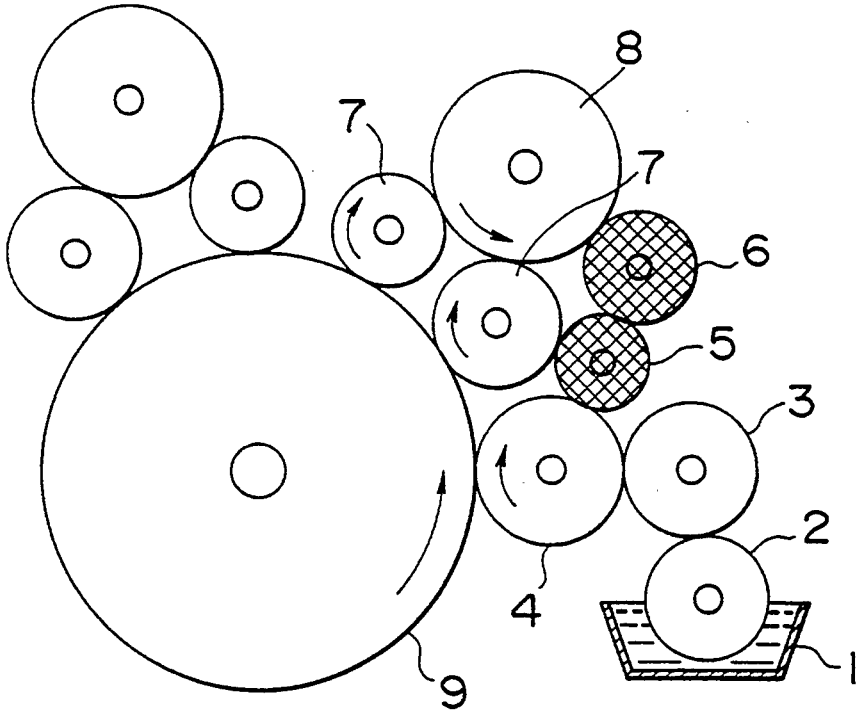
FIG. 1 is a side elevational view showing a wetting apparatus for offset printing machines according to a first embodiment of the present invention.
Figure 2A:
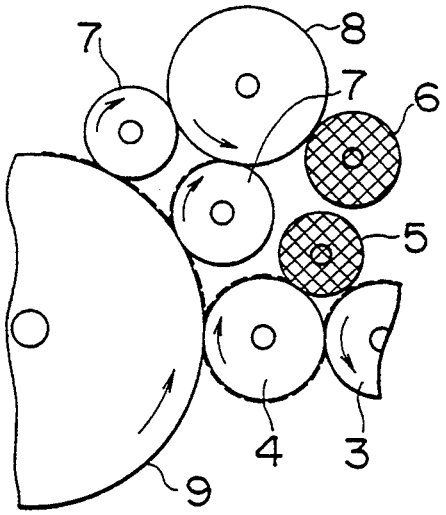
FIGS. 2(*a*)–2(*d*) are diagrams used to explain four different contact states in which a dampening solution is fed to a printing surface in accordance with the first embodiment of the present invention.
Figure 2B:
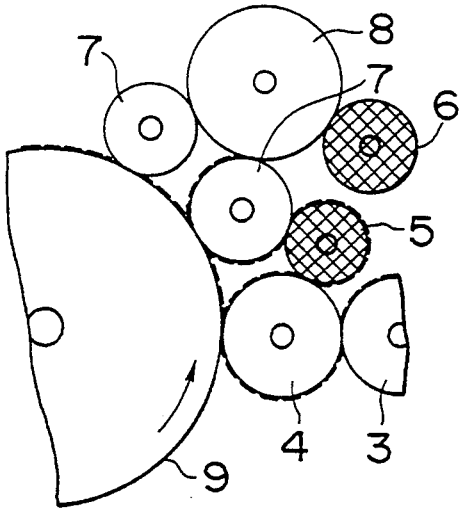
Figure 2C:
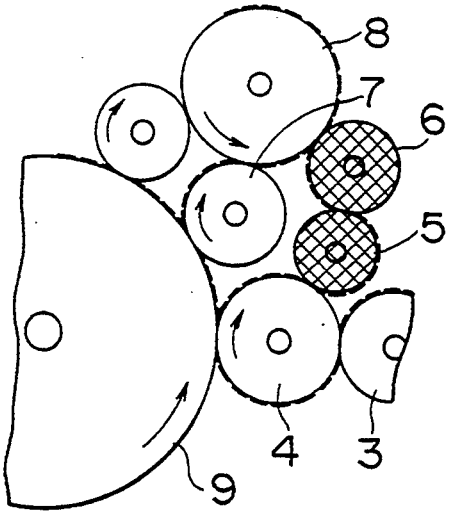
Figure 2D:
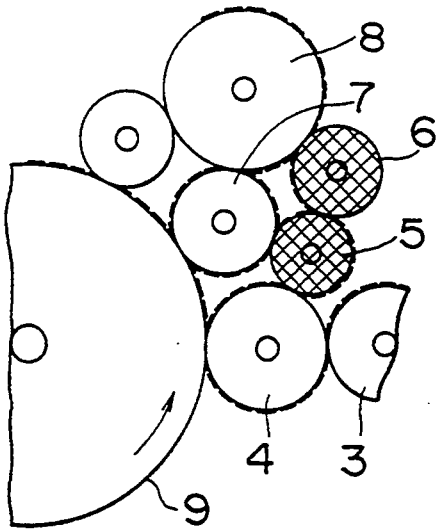

Referring now in greater detail to the drawings, initially to FIGS. 1 and 2(*a*)–2(*d*), there is shown a wetting apparatus for offset printing machines in accordance with a first embodiment of the present invention. The wetting apparatus is constituted by a wetting water feed system and a dampening solution dispersion system. The wetting water feed system comprises a first wetting roller 2 immersed in a wetting water pan 1, a metering roller 3 for forming an appropriate wetting water film on the first wetting roller 2, and a second wetting roller 4 rotatably in contact with the metering roller 3. The dampening solution dispersion system comprises an ink receiving roller 5 rotatably in contact with the second wetting roller 4 and an ink transferring roller 6 rotatably in contact with a vibrating roller 8.

The ink receiving roller 5 is brought into contact with an ink application roller 7 and driven to rotate by a drive unit (not shown). The ink transferring roller 6 is brought into contact with the ink receiving roller 5 and driven to rotate by a drive unit (not shown). These drive units comprise an air cylinder and a link mechanism, but other drive units may be used.

The operation of the wetting apparatus of the offset printing machine will hereinafter be described in detail. FIGS. 2(*a*)–2(*d*) illustrate four different states in which the supply of the dampening solution to the printing surface 9 is performed with four different feed patterns (indicated by broken lines) by moving the ink receiving roller 5 and the ink transferring roller 6 and varying the manner of contacts among the rollers.

FIG. 2(*a*) illustrates a contact configuration in which, when printing is performed while the dampening solution is being fed continuously to the printing surface 9 through the first wetting roller 2, the metering roller 3 and the second wetting roller 4, the dampening solution is fed from the second wetting roller 4 to the printing surface 9. In this state, the ink transferring roller 6 is moved away from the ink receiving roller 5, and the ink receiving roller 5 is moved away from the ink application roller 7. In this case, the excessive emulsification of the ink apparatus is prevented, as in the case of the continuous wetting apparatus of the printing surface wetting type described above. Further, non-uniformity in a film of dampening solution occurs due to a large thickness of the dampening solution film, which is a drawback of the continuous wetting apparatus of the printing surface wetting type, becomes smoothed out by the ink receiving roller 5. The smoothing is true of the ink transferring roller 6 rotating in contact with the vibrating roller 8, too. The aforementioned contact configuration provides a manner of wetting mainly suitable for prints having a low ratio of picture-line portions, and for convenience of explanation, this manner of wetting is called a printing surface wetting type.

FIG. 2(*b*) illustrates a contact configuration in which, when printing is performed while the dampening solution is being fed continuously to the printing surface 9 through the first wetting roller 2, the metering roller 3 and the second wetting roller 4, the dampening solution is fed from the second wetting roller 4 to the ink receiving roller 5 and the ink application roller 7 and then to the printing surface 9. In this state, the ink receiving roller 5 is brought into contact with the ink application roller 7 and rotated with it. At the same time, the ink transferring roller 6 is moved away from the ink receiving roller 5. This provides a manner of wetting mainly suitable for prints with a relatively high ratio of picture-line portions, and for convenience of explanation, this manner of wetting is called a combination type (1). Since in the combination type (1) the ink flows from the ink application roller 7 to the ink receiving roller 5 and to the second wetting roller 4, both the dampening solution and the ink are fed by the second wetting roller 4. As a consequence, the transfer of the ink to the printing surface 9 is increased and a smoothing effect is obtained and roller eyes and ghosts are eliminated. The difference between the combination type (1) and the aforementioned conventional combination type is that the ink receiving roller 6 is in contact with the vibrating roller 8. The excessive emulsification water on the vibrating roller 8 is evaporated by the ink receiving roller 6 in contact with the vibrating roller 8.

FIG. 2(*c*) illustrates a contact configuration in which, when printing is performed while the dampening solution is being fed continuously to the printing surface 9 through the first wetting roller 2, the metering roller 3 and the second wetting roller 4, the dampening solution is fed from the second wetting roller 4 to the ink receiving roller 5, the ink transferring roller 6, the vibrating roller 8, and the ink application roller 7, and then to the printing surface 9. In this manner of contacts among the rollers, the ink receiving roller 5 is rotated in contact with the second wetting roller 4. At the same time, the ink receiving roller 5 is moved away from the ink application roller 7. The characteristic of this contact configuration is that the dampening solution is fed to the vibrating roller 8 and not the ink application roller 7. Therefore, a proper degree of emulsification of the ink apparatus is quickly obtained and an excessive emulsification of the ink application roller 7 is prevented. This manner of wetting is an improvement in the combination type (1) described above and can prevent the excessive emulsification of the ink application roller 7. For convenience of explanation, this manner of wetting is called a combination type (2).

FIG. 2(*d*) illustrates a contact configuration in which, when printing is performed while the dampening solution is being fed continuously to the printing surface 9 through the first wetting roller 2, the metering roller 3 and the second wetting roller 4, the dampening solution is fed from the second wetting roller 4 to the ink receiving roller 5, the ink transferring roller 6, the vibrating roller 8 and the ink application roller 7 and to the printing surface 9 and also fed from the second wetting roller 4 to the ink receiving roller 5 and the ink application roller 7 and to the printing surface 9. In this state, the ink receiving roller 5 is rotated in contact with the ink receiving roller 6 and with the ink application roller 7. This contact configuration provides a manner of wetting especially suitable for prints with a high ratio of picture-line portions, and for convenience of explanation, this manner of wetting is called a combination type (3). Since in the combination type (3) the ink apparatus is quickly emulsified, an appropriate film of dampening solution can be held on the hydrophilic portion of the printing surface, even if a lot of ink is required as in the case of high ratios of picture-line portions.

As described above, the wetting can be controlled, and an appropriate emulsification state corresponding to the ratio of picture-line portions or picture-line state of prints can be obtained. Therefore, the wetting apparatus according to the present invention is a wetting water feed means that is extremely useful and of the multiple type. In the multiple type wetting water feed mean, the manner of wetting with the dampening solution can freely be varied depending upon the arrangement of the ink transferring roller 6. In addition, if the wetting water feed means according to the present invention is operated together with a picture-line area ratio meter, the following effect can be obtained. For example, in polychromatic offset printing machines and the like, printing for each color can be performed in a most desirable state by varying the manner of wetting for each printing color. Systematizing a selection of the manner of wetting is relatively simple and more effective.

Figure 3:
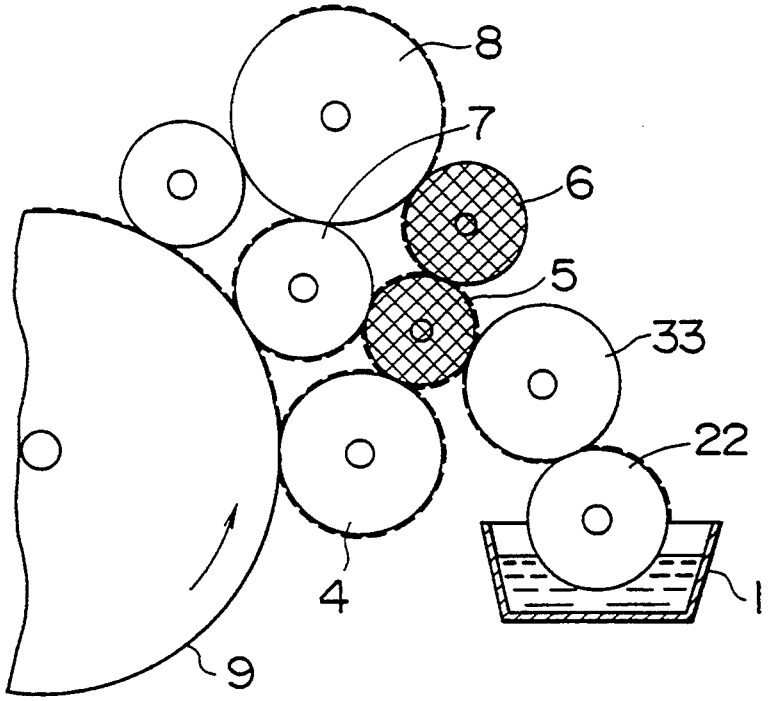
FIG. 3 is a side elevational view showing a wetting apparatus for offset printing machines according to a second embodiment of the present invention.
Figure 4A:
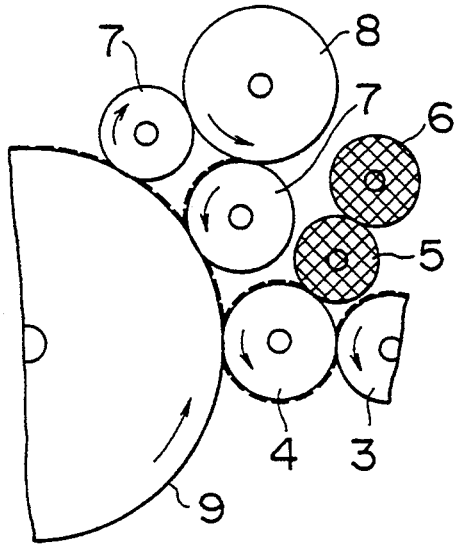
FIGS. 4(*a*)–4(*d*) are diagrams used to explain four different contact states in which a feed of dampening solution to a printing surface is performed in accordance with a wetting apparatus for offset printing apparatuses according to a third embodiment of the present invention.
Figure 4B:
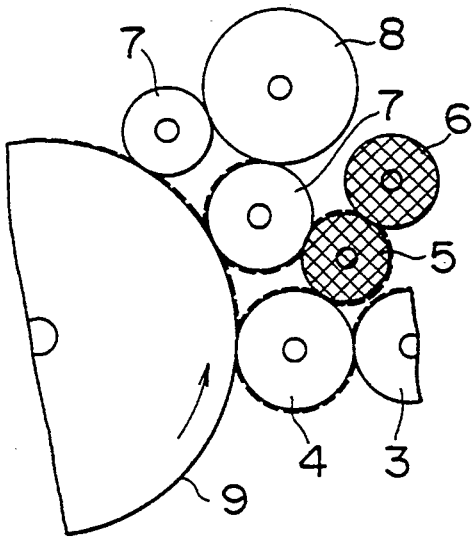
Figure 4C:
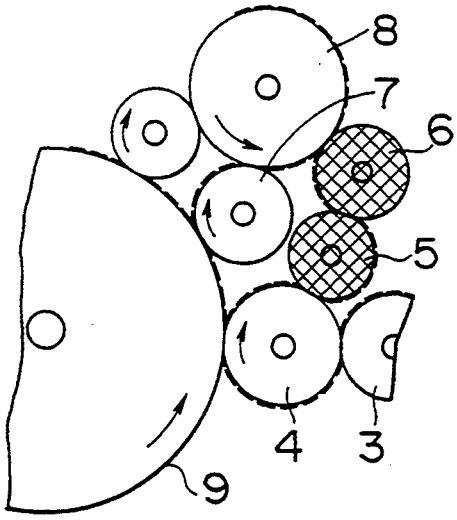
Figure 4D:
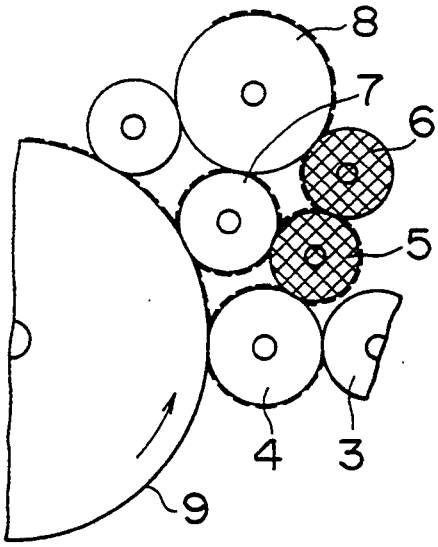
Figure 5A:
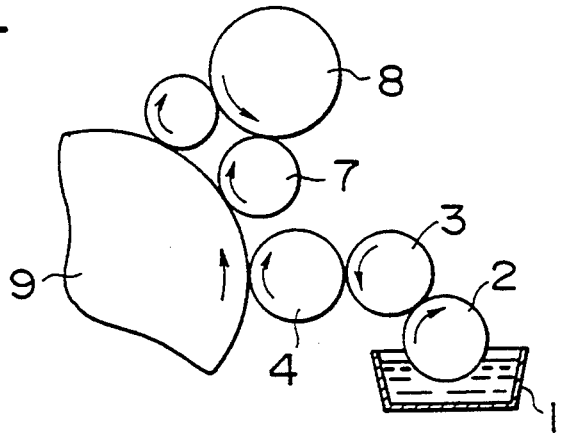
FIG. 5(a) RELATED ART
FIG. 5(*a*) is a side view showing a conventional wetting apparatus of the printing surface wetting type of an offset printing machine.
Figure 5B:
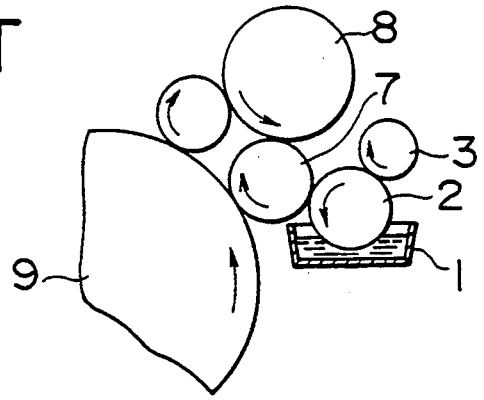
FIG. 5(b) RELATED ART
Figure 5C:
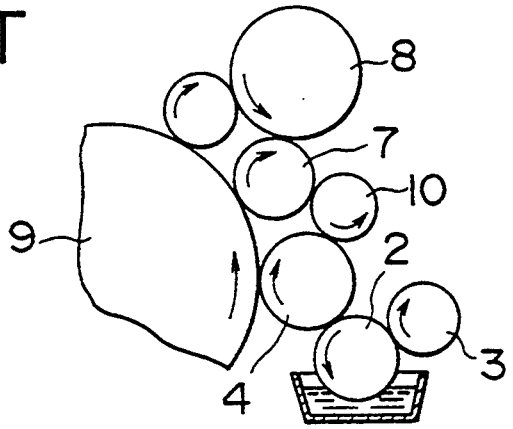
FIG. 5(c) RELATED ART

FIG. 3 shows a wetting apparatus for offset printing machines according to a second embodiment of the present invention. Many of the parts of the second embodiment of FIG. 3 are identical to corresponding parts of the first embodiment of FIG. 1 and therefore the same reference numerals will be applied to the identical parts. Reference numeral 22 denotes a first wetting roller immersed in a wetting water pan 1, and reference numeral 33 denotes a metering roller. The metering roller 33 rotates in contact with an ink receiving roller 5. In this embodiment, when printing is performed while the dampening solution is being fed continuously to the printing surface 9 through the first wetting roller 22, the metering roller 33 and the second wetting roller 4, the dampening solution is substantially equally fed to the printing surface 9 and the ink apparatus, by rotating the metering roller 33 in contact with the ink receiving roller 5. In this method, the speed of emulsification of the ink apparatus can be accelerated, fluctuations in the printing density at the beginning of printing can be controlled, and the amount of consumption of the dampening solution can be reduced. Although in this embodiment the ink and the dampening solution in the roller width direction are evened by the vibrating roller 8, the ink receiving roller 5 and the metering roller 33, it is noted that the ink and the dampening solution in the roller width direction may be made uniform by oscillating the other rollers.

A wetting apparatus for offset printing machines constructed in accordance with the second aspect of the present invention will hereinafter be described in conjunction with the embodiments shown in FIGS. 1 and 4. The wetting apparatus is constituted by a wetting water feed system and a dampening solution dispersion system. The wetting water feed system comprises a first wetting roller 2 immersed in a wetting water pan 1, a metering roller 3 for forming an appropriate film of wetting water transferred onto the first wetting roller 2, and a second wetting roller 4 rotatably in contact with the metering roller 3. The dampening solution dispersion system comprises an ink receiving roller 5 rotatably in contact with the second wetting roller 4 and an ink transferring roller 6 rotatably and selectively contactable with the ink receiving roller or a vibrating roller 8. The ink receiving roller 5 that rotates in contact with the second wetting roller 4 is brought into contact with an ink application roller 7 and driven to rotate by a drive unit (not shown). The ink transferring roller 6 is selectively brought into contact with the ink receiving roller 5 and driven to rotate by a drive unit (not shown). These drive units comprise an air cylinder and a link mechanism, but other drive units may be used.

The operation of the wetting apparatus of the offset printing machine will hereinafter be described in detail. FIGS. 4(*a*)–4(*d*) illustrate four different states in which the feed of the dampening solution to the printing surface 9 is performed with four different feed patterns (indicated by broken lines) by moving the ink receiving roller 5 and the ink transferring roller 6 and varying a configuration of contacts.

FIG. 4(*a*) illustrates a contact configuration wherein, when printing is performed while the dampening solution is being fed continuously to the printing surface 9 through the first wetting roller 2, the metering roller 3 and the second wetting roller 4, the dampening solution is fed from the second wetting roller 4 to the printing surface 9. In this state, the ink receiving roller 5 and the ink transferring roller 6 are moved away from the ink application roller 7 and the vibrating ink roller 8. In this case, the excessive emulsification of the ink apparatus is prevented, as in the case of the continuous wetting apparatus of the printing surface wetting type described above. Further, an unevenness of a dampening solution film caused by large thickness of the film, which unevenness is a drawback of the continuous wetting apparatus of the printing surface wetting type, is smoothed by the ink receiving roller 5 and the ink transferring roller 6.

FIG. 4(*b*) illustrates a contact configuration wherein, when printing is performed while the dampening solution is being fed continuously to the printing surface 9 through the first wetting roller 2, the metering roller 3 and the second wetting roller 4, the dampening solution is fed from the second wetting roller 7 to the printing surface 9 and fed from the second wetting roller 4 to the ink receiving roller 5 and the ink application roller 7 and to the printing surface 9, respectively. In this state, the ink receiving roller 5 is brought into contact with the ink application roller 7 and rotated. At the same time, the ink transferring roller 6 is moved away from the vibrating roller 7. This contact configuration is a manner of wetting mainly suitable for prints with relatively high ratios of picture-line portions, and for convenience of explanation, this manner of wetting is called a combination type (4). Since in the combination type (4) the ink flows from the ink application roller 7 to the ink receiving roller 5 and to the wetting roller 4, both the dampening solution and the ink are by the second wetting roller 4. As a consequence, the transfer of the ink to the printing surface 9 is increased and a smoothing effect is obtained. In addition, since the dampening solution is smoothed by the ink transferring roller 6 contacting with the ink receiving roller 5, roller eyes and ghosts are prevented.

FIG. 4(*c*) illustrates a contact configuration wherein, when printing is performed while the dampening solution is being fed continuously to the printing surface 9 through the first wetting roller 2, the metering roller 3 and the second wetting roller 4, the dampening solution is fed from the second wetting roller 4 to the printing surface 9 and fed from the second wetting roller 4 to the ink receiving roller 5, the ink transferring roller 6, the vibrating roller 8 and the ink application roller 7 and to the printing surface 9, respectively. In this state, the ink receiving roller 5 is rotated in contact with the ink transferring roller 6, and the ink transferring roller 6 is rotated in contact with the vibrating roller 8. At the same time, the ink receiving roller 5 is moved away from the ink application roller 7. The characteristic of this contact configuration is that the dampening solution is fed to the vibrating roller 8 and not the ink application roller 7. Therefore, a proper degree of emulsification of the ink apparatus is quickly obtained and an excessive emulsification of the ink application roller 7 is prevented. This manner of wetting is an improvement in the combination type (4) described above and can prevent the excessive emulsification of the ink application roller 7. For convenience of explanation, this manner of wetting is called a combination type (5).

FIG. 4(*d*) illustrates a contact configuration wherein, when printing is performed while the dampening solution is being fed continuously to the printing surface 9 through the first wetting roller 2, the metering roller 3 and the second wetting roller 4, the dampening solution is fed from the second wetting roller 4 to the printing surface 9 and also fed from the second wetting roller 4 to the ink receiving roller 5 and the ink application roller 7 and to the printing surface 9 and further fed from the second wetting roller 4 to the ink receiving roller 5, the ink transferring roller 6, the vibrating roller 8 and the ink application roller 7 and to the printing surface 9. In this state, the ink receiving roller 5 is rotated in contact with the ink receiving roller 6 and with the ink application roller 7, and the ink transferring roller 6 is rotated in contact with the vibrating roller 8. This contact configuration provides a manner of wetting especially suitable for printed matters with high ratios of picture-line portions, and for convenience of explanation, the manner of wetting is called a combination type (6). Since in the combination type (6) the ink apparatus is quickly emulsified, an appropriate film of dampening solution can be held on the hydrophilic portion of the printing surface, even if a lot of ink is required as in the case of high ratios of picture-line portions.

As described above, the wetting can be controlled and an appropriate emulsification corresponding to the ratio of picture-line portions or picture-line state of printed matters can be obtained. Therefore, the wetting apparatus has a wetting water feed means that is extremely useful and of the multiple type, as in the case of the invention described above. In the multiple type wetting water feed means, the manner of wetting with the dampening solution can freely be varied depending upon the arrangement of the ink transferring roller 6. In addition, if the wetting water feed means according to the present invention is operated together with a picture-line area ratio meter, the following effect can be obtained. For example, in polychromatic offset printing machines and the like, printing for each color can be performed under the most desirable conditions by varying the manner of wetting for each printing color. Systematizing a selection of the wetting manner is relatively simple and effective.

While the invention has been described with relation to the preferred embodiments, various modifications and adaptations thereof will now be apparent to those skilled in the art. All such modifications and adaptations as fall within the scope of the appended claims are intended to be covered thereby.

What we claim is:

1. A wetting apparatus for an offset printing machine comprising:

a first wetting roller;

a pan for holding dampening solution, said first wetting roller being immersed in said pan;

a metering roller being in contact with the first wetting roller;

a printing surface;

a second wetting roller being in contact with said printing surface and the metering roller;

an ink application roller being in contact with the printing surface;

an ink receiving roller rotatably mounted and being in contact with the second wetting roller and being movably mounted for contact with and being separated from at least one of the metering roller and the ink application roller;

a vibrating roller for vibrating and rotating and being in contact with the ink application roller; and an ink transferring roller rotatably mounted and being in contact with the vibrating roller and being movably mounted for contacting with and being separated from the ink receiving roller;

wherein printing while continuously feeding the dampening solution to the printing surface through said first wetting roller immersed in the dampening solution pan and said metering roller and said second wetting roller being in contact with the printing surface, said ink transferring roller being displaced away from the ink receiving roller, and the ink receiving roller being displaced away from the ink application roller, said ink application roller being in contact with the printing surface, the dampening solution being supplied from the second wetting roller to the printing surface.

2. A wetting apparatus for an offset printing machine comprising:

a first wetting roller;

a pan for holding dampening solution, said first wetting roller being immersed in said pan;

a metering roller being in contact with the first wetting roller;

a printing surface;

a second wetting roller being in contact with said printing surface and the metering roller;

an ink application roller being in contact with the printing surface;

an ink receiving roller rotatably mounted and being in contact with the second wetting roller and being movably mounted for contact with and being separated from at least one of the metering roller and the ink application roller;

a vibrating roller for vibrating and rotating and being in contact with the ink application roller; and an ink transferring roller rotatably mounted and being in contact with the vibrating roller and being movably mounted for contacting with and being separated from the ink receiving roller;

wherein when printing while continuously feeding the dampening solution to the printing surface through said first wetting roller immersed in the dampening solution pan, the metering roller, and the second wetting roller being in contact with the printing surface; the ink receiving roller being displaced into contact and rotation with the ink application roller and the ink transferring roller being displaced away from the ink receiving roller for supplying the dampening solution to the printing surface from the second wetting roller through the ink receiving roller and the ink application roller.

3. A wetting apparatus for an offset printing machine comprising:

a first wetting roller;

a pan for holding dampening solution, said first wetting roller being immersed in said pan;

a metering roller being in contact with the first wetting roller;

a printing surface;

a second wetting roller being in contact with said printing surface and the metering roller;

an ink application roller being in contact with the printing surface;

an ink receiving roller rotatably mounted and being in contact with the second wetting roller and being movably mounted for contact with and being separated from at least one of the metering roller and the ink application roller;

a vibrating roller for vibrating and rotating and being in contact with the ink application roller; and an ink transferring roller rotatably mounted and being in contact with the vibrating roller and being movably mounted for contacting with and being separated from the ink receiving roller;

wherein printing while continuously feeding the dampening solution to the printing surface through the first wetting roller immersed in the dampening solution pan and the metering roller and the second wetting roller being in contact with the printing surface, the ink transferring roller being displaced into contact and rotation with the ink receiving roller, and the ink receiving roller being displaced away from the ink application roller for supplying the dampening solution to the printing surface from the second wetting roller through the ink receiving roller and the ink transferring roller and the vibrating roller and ink application roller.

4. A wetting apparatus for an offset printing machine comprising:

a first wetting roller;

a pan for holding dampening solution, said first wetting roller being immersed in said pan;

a metering roller being in contact with the first wetting roller;

a printing surface;

a second wetting roller being in contact with said printing surface and the metering roller;

an ink application roller being in contact with the printing surface;

an ink receiving roller rotatably mounted and being in contact with the second wetting roller and being movably mounted for contact with and being separated from at least one of the metering roller and the ink application roller;

a vibrating roller for vibrating and rotating and being in contact with the ink application roller; and an ink transferring roller rotatably mounted and being in contact with the vibrating roller and being movably mounted for contacting with and being separated from the ink receiving roller;

wherein printing while continuously feeding the dampening solution to the printing surface through the first wetting roller immersed in the dampening solution pan and the metering roller and the second wetting roller being in contact with the printing surface, the ink transferring roller being displaced into contact and rotation with the ink receiving roller and the ink receiving roller being displaced into contact and rotation with the ink application roller, for supplying the dampening solution to the printing surface from the second wetting roller through the ink receiving roller and the ink transferring roller and the vibrating roller and the ink application roller and from the second wetting roller through the ink receiving roller and the ink application roller.

5. A wetting apparatus for an offset printing machine comprising:

a first wetting roller;

a pan for holding dampening solution, said first wetting roller being immersed in said pan;

a metering roller being in contact with the first wetting roller;

a printing surface;

a second wetting roller being in contact with said printing surface;

an ink application roller being in contact with the printing surface;

an ink receiving roller rotatably mounted and being in contact with the second wetting roller and the ink application roller;

a vibrating roller for vibrating and rotating and being in contact with the ink application roller; and an ink transferring roller rotatably mounted and being in contact with the vibrating roller and being movably mounted for contacting with and being separated from the ink receiving roller;

wherein printing while continuously feeding the dampening solution to the printing surface through the first wetting roller immersed in the dampening solution pan and the metering roller and the second wetting roller being in contact with the printing surface, the ink receiving roller being in contact and rotation with the metering roller for supplying the dampening solution to the printing surface from the metering roller.

6. A wetting method for an offset printing machine having a first wetting roller, a pan for holding dampening solution, said first wetting roller being immersed in said pan, a metering roller being in contact with the first wetting roller, a printing surface, a second wetting roller being in contact with said printing surface and the metering roller, an ink application roller being in contact with the printing surface, an ink receiving roller rotatably mounted and being in contact with the second wetting roller and being movably mounted for contact with and being separated from at least one of the metering roller and the ink application roller, a vibrating roller for vibrating and rotating and being in contact with the ink application roller and an ink transferring roller being movably mounted for contacting with and being separated from the ink receiving roller and the vibrating roller comprising the following steps:

printing while continuously feeding the dampening solution to the printing surface through the first wetting roller immersed in the dampening solution pan and the metering roller and the second wetting roller being in contact with the printing surface;

displacing the ink transferring roller into contact and rotation only with the ink receiving roller; and feeding the dampening solution to the printing surface through the second wetting roller.

7. A wetting method for an offset printing machine having a first wetting roller, a pan for holding dampening solution, said first wetting roller being immersed in said pan, a metering roller being in contact with the first wetting roller, a printing surface, a second wetting roller being in contact with said printing surface and the metering roller, an ink application roller being in contact with the printing surface, an ink receiving roller rotatably mounted and being in contact with the second wetting roller and being movably mounted for contact with and being separated from at least one of the metering roller and the ink application roller, a vibrating roller for vibrating and rotating and being in contact with the ink application roller and an ink transferring roller being movably mounted for contacting with and being separated from the ink receiving roller and the vibrating roller comprising the following steps:

printing while continuously feeding the dampening solution to the printing surface through the first wetting roller immersed in the dampening solution pan and the metering roller and the second wetting roller being in contact with the printing surface;

displacing the ink receiving roller into contact and rotation with the ink application roller; and feeding the dampening solution to the printing surface through the ink application roller.

8. A wetting method for an offset printing machine having a first wetting roller, a pan for holding dampening solution, said first wetting roller being immersed in said pan, a metering roller being in contact with the first wetting roller, a printing surface, a second wetting roller being in contact with said printing surface and the metering roller, an ink application roller being in contact with the printing surface, an ink receiving roller rotatably mounted and being in contact with the second wetting roller and being movably mounted for contact with and being separated from at least one of the metering roller and the ink application roller, a vibrating roller for vibrating and rotating and being in contact with the ink application roller and an ink transferring roller being movably mounted for contacting with and being separated from the ink receiving roller and the vibrating roller comprising the following steps:

printing while continuously feeding the dampening solution to the printing surface through the first wetting roller immersed in the dampening solution pan and the metering roller and the second wetting roller being in contact with the printing surface;

displacing the ink transferring roller into contact and rotation with the vibrating roller;

displacing the ink receiving roller into contact and rotation with the ink transferring roller; and feeding the dampening solution to the printing surface through the vibrating roller and the ink application roller.

9. A wetting method for an offset printing machine having a first wetting roller, a pan for holding dampening solution, said first wetting roller being immersed in said pan, a metering roller being in contact with the first wetting roller, a printing surface, a second wetting roller being in contact with said printing surface and the metering roller, an ink application roller being in contact with the printing surface, an ink receiving roller rotatably mounted and being in contact with the second wetting roller and being movably mounted for contact with and being separated from at least one of the metering roller and the ink application roller, a vibrating roller for vibrating and rotating and being in contact with the ink application roller and an ink transferring roller being movably mounted for contacting with and being separated from the ink receiving roller and the vibrating roller comprising the following steps:

printing while continuously feeding the dampening solution to the printing surface through the first wetting roller immersed in the dampening solution pan and the metering roller and the second wetting roller being in contact with the printing surface;

displacing the ink transferring roller into contact and rotation with the vibrating roller;

displacing the ink receiving roller into contact with the ink application roller; and feeding the dampening solution to the printing surface through the vibrating roller and the ink application roller.

* * * * *